US007114884B2

(12) United States Patent
Horne et al.

(10) Patent No.: US 7,114,884 B2
(45) Date of Patent: Oct. 3, 2006

(54) METHOD AND APPARATUS FOR INCREASING FLOATING PLATFORM BUOYANCY

(75) Inventors: Earl Wilson Horne, Houston, TX (US); Andrew Kyriakides, Houston, TX (US)

(73) Assignee: Seahorse Equipment Corporation, Houston, TX (US)

( * ) Notice: Subject to any disclaimer, the term of this patent is extended or adjusted under 35 U.S.C. 154(b) by 0 days.

(21) Appl. No.: 11/195,362

(22) Filed: Aug. 1, 2005

(65) Prior Publication Data

US 2006/0088387 A1 Apr. 27, 2006

(51) Int. Cl.
*E02D 23/02* (2006.01)

(52) U.S. Cl. ..... 405/206; 405/195.1; 405/205; 114/264

(58) Field of Classification Search ..... 405/195.1, 405/203, 205, 206; 114/264, 293
See application file for complete search history.

(56) References Cited

U.S. PATENT DOCUMENTS 5,277,521 A 1/1994 Petkovic et al.
5,507,598 A 4/1996 Huete
5,707,178 A 1/1998 Srinivasan
6,012,873 A 1/2000 Copple et al.
6,155,748 A 12/2000 Allen et al.
6,244,785 B1 6/2001 Richter et al.
6,435,773 B1 * 8/2002 Khachaturian ..... 405/202
6,575,665 B1 6/2003 Richter et al.
6,652,192 B1 11/2003 Xu et al.
6,688,250 B1 * 2/2004 Davies et al. ..... 114/264

* cited by examiner

*Primary Examiner*—Raymond Addie
(74) *Attorney, Agent, or Firm*—Nick A. Nichols, Jr.

(57) ABSTRACT

A floating platform for recovery of oil and gas from offshore oil and gas fields includes a hull having a portion located substantially below the water surface, and including a portion thereof which extends above the water surface. The platform is anchored to the seabed by one or more tendons secured to the base of the hull and to the seabed. The payload capacity of the floating platform is increased without redesigning the structural design of the hull by attaching a column extension or mounting a detachable buoyancy module to the lower end of the hull for accommodating changing platform payload requirements.

8 Claims, 4 Drawing Sheets

METHOD AND APPARATUS FOR INCREASING FLOATING PLATFORM BUOYANCY

BACKGROUND OF THE DISCLOSURE

The present invention relates generally to floating platform systems for testing and producing hydrocarbon formations found in deep (600–10,000 feet) offshore waters. More particularly, the invention relates to a method and system for changing the buoyancy of the floating platform to accommodate changes in platform payload and water depth requirements without redesigning the platform hull.

The exploration for oil and gas deposits in offshore waters, and recovery of the oil and gas therefrom is very expensive. Large capital expenditures are required and thus only large oil and gas deposits justify such expenditures. Smaller oil and gas deposits usually do not justify large capital investments and therefore are deemed to be uneconomical to produce.

Various methods and offshore production systems have been utilized to locate and recover offshore oil and gas deposits. Production systems such as converted Mobile Offshore Drilling Units ("MODU") and Tendon Leg Platforms (TLP) are typically used in deep waters. Even these systems, however, can be quite expensive to manufacture and install.

There continues to be a need for improved platform and drilling systems, particularly for use in deep waters, which would justify the economic investment to produce even relatively small oil and gas fields. Drilling and production platforms, such as TLP's, are engineered for use in particular offshore environments and to support a maximum payload. The specifications for the platform are based on assumptions which may or may not prove to be accurate once the platform is installed and in use for a period of time. Other factors, such as the discovery of recoverable oil and gas from adjacent deposits may alter the payload requirements for a platform already in use. Thus, being able to increase the payload a platform can support without redesigning the hull would be highly desirable and significantly reduce the cost of producing offshore oil and gas deposits. Cost reductions can also be had by eliminating the need for completely redesigning the hull and node structure of the platform to accommodate different payload requirements. The buoyancy of a floating platform may be increased by extending the column length of the platform rather than redesigning the hull, thereby saving time and engineering costs associated with redesigning the platform hull.

It is therefore an object of the present invention to provide a floating platform adapted to support an increase in payload capacity without redesigning the structural design of the hull of the platform. The increase in payload capacity is accommodated by attaching a column extension to the lower end hull of the platform while in the fabrication yard.

It is another object of the present invention to provide a floating platform whereby the payload capacity of the platform may be increased after the platform is located in the filed. Such an increase in payload capacity is provided by attaching a buoyancy module to the platform hull rather than redesigning the hull and node structure of the platform.

SUMMARY OF THE INVENTION

The present invention provides a floating platform for recovery of oil and gas from offshore oil and gas fields. The platform supports one or more decks above the water surface to accommodate equipment for drilling and processing oil, gas and water recovered from the oil and gas field. In a preferred embodiment, the platform includes a hull having a portion located substantially below the water surface, and including a portion which extends above the water surface. The platform hull includes a base and is anchored to the seabed by one or more tendons secured to the base of the hull at one end thereof and to the seabed at the opposite ends of the tendons. The payload carrying capacity of the platform is increased without redesigning the structural design of the platform hull by attaching a column extension to the bottom of the hull of the platform.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Figure 1:
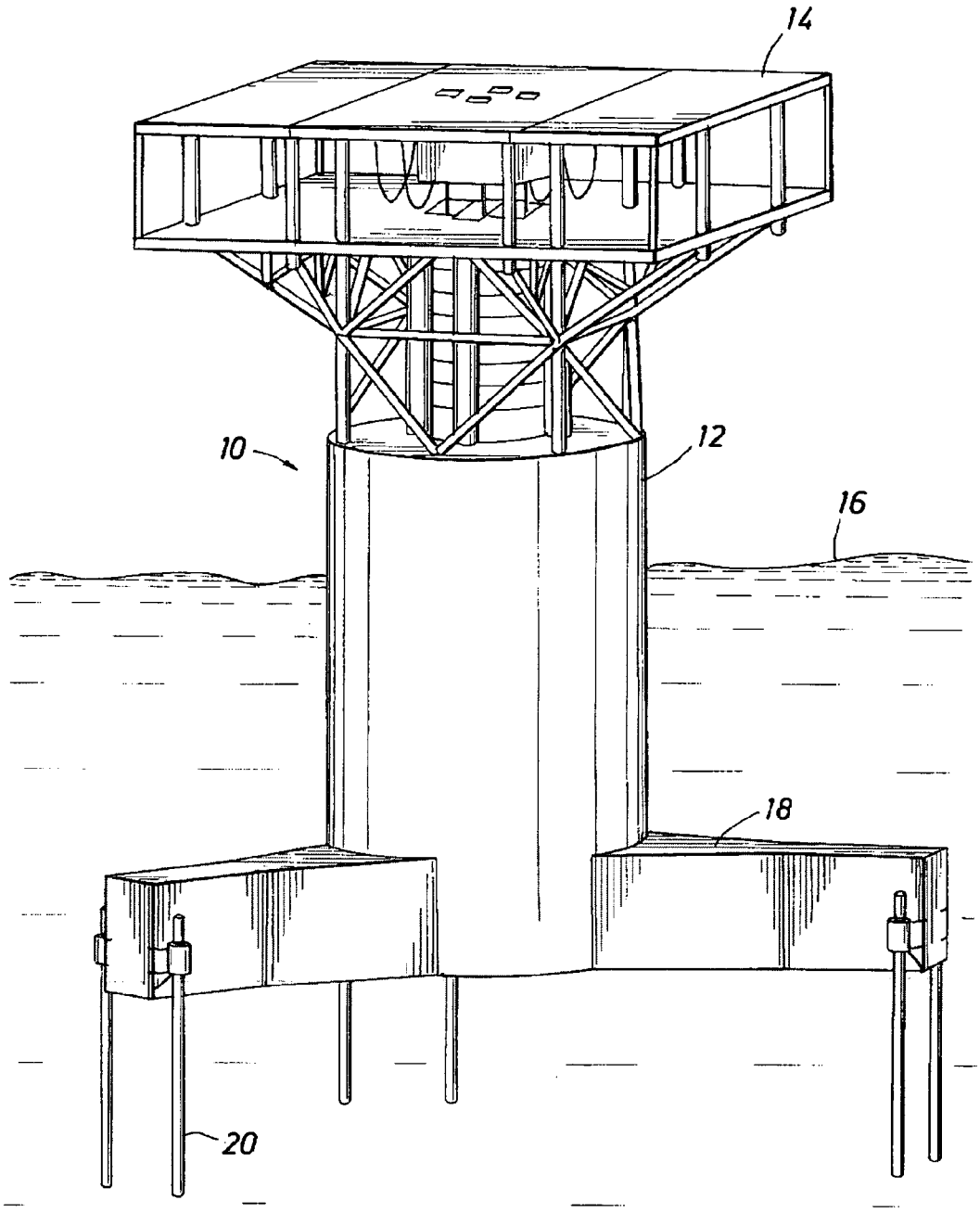
FIG. 1 is a side view of a floating platform anchored to the seabed.

Referring first to FIG. 1, the floating platform of the invention is generally identified by the reference numeral 10. The platform 10 includes a central column or hull 12 which provides positive buoyancy and vertical support for the platform 10. One or more decks 14 are supported on the hull 12 above the water surface 16. Drilling and/or production equipment necessary for the recovery and processing of oil, gas and water recovered from the oil and gas field are secured on the deck 14.

The hull 12 extends upward from the base or keel of the hull 12. The base node of the hull 12 includes pontoons 18 extending radially outward from the hull 12. The platform 10 is anchored to the seabed by tendons 20 secured at one end thereof to the pontoons 18 and at the opposite ends thereof to foundation piles (not shown in the drawings) embedded in the seabed. The hull 12 provides sufficient buoyancy to support the payload of the platform 10, which payload includes the deck 14, drilling and/or completion equipment, production facilities, production and drilling risers and sufficient excess buoyancy to develop the tendon pre-tension.

The platform 10 is designed for the environmental and depth conditions at the offshore location of an oil and gas deposit of interest. At other locations, other platforms may be required to efficiently recover the oil and gas from other subsea deposits. Such other platforms may be required to carry a greater payload than the platform 10 is designed to support. The increased payload, however, may be accommodated by increasing the buoyancy of the platform 10. An increase in buoyancy may be accomplished by extending the length of the hull 12 rather than redesigning the structural design of the hull and base node structure of the platform 10. Likewise, the payload requirements for a platform may increase after installation, in which case a buoyancy module 32, as shown in FIG. 3, may be mounted to the bottom of the hull 12 of the platform 10.

Figure 2:
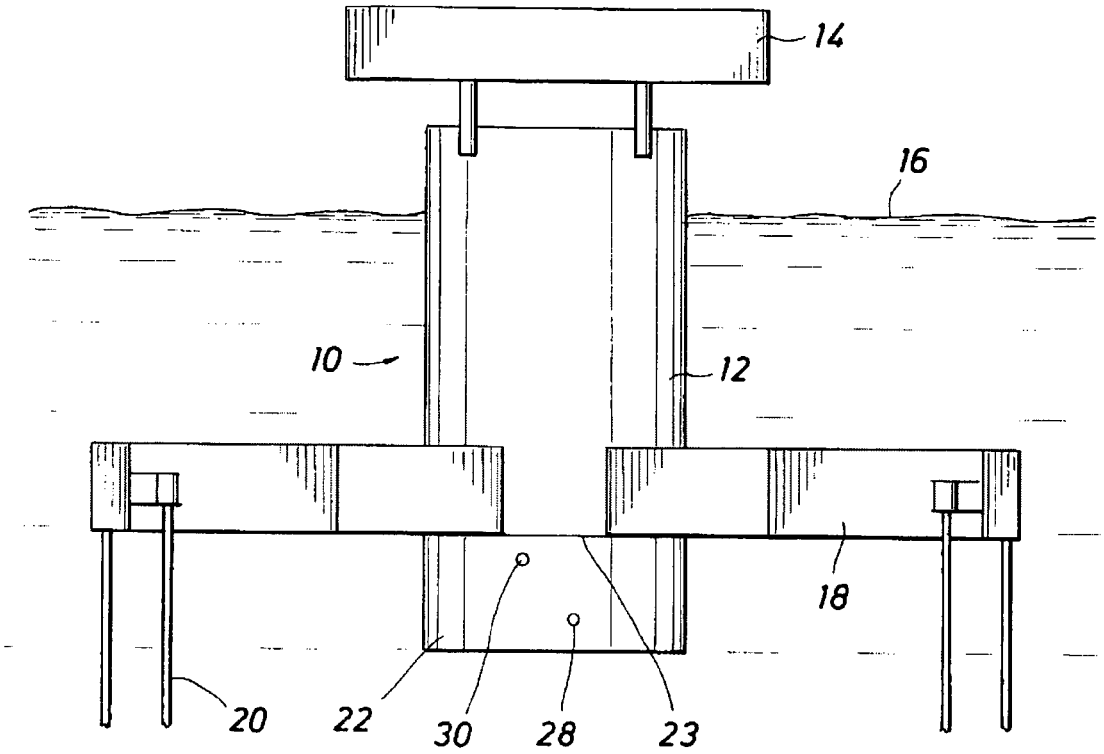
FIG. 2 is a side view of the floating platform of the invention including a buoyancy extension attached to the bottom of the hull of the platform.

Referring now to FIG. 2, the column extension 22 is a relatively short cylindrical chamber having an outside diameter approximately equal to the outside diameter of the hull 12. The column extension 22 is welded to the bottom of the hull 12 at weld 23 at the fabrication or construction site of the platform 10.

Figure 3:
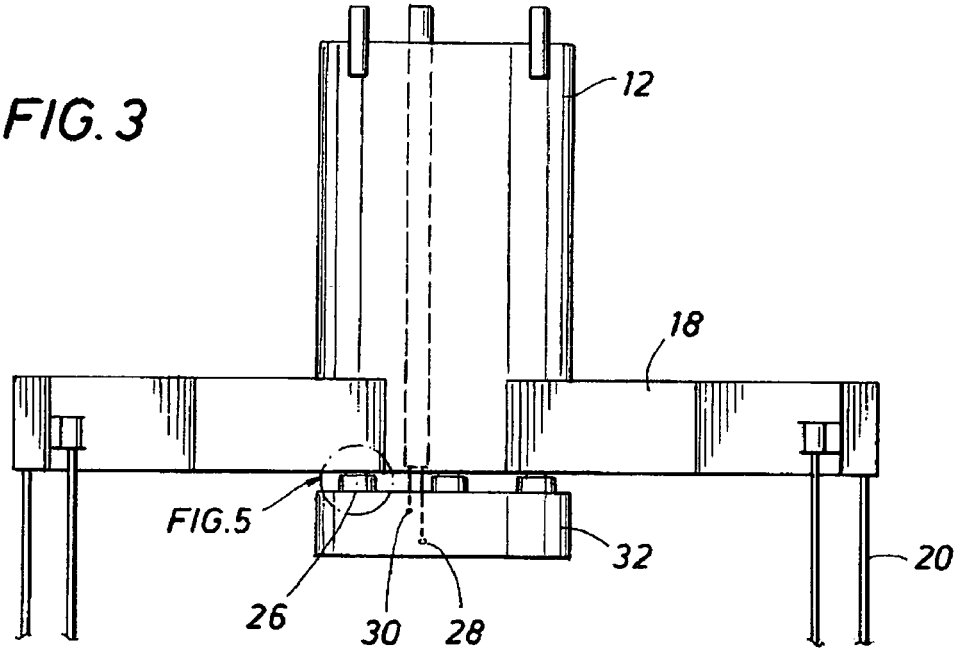
FIG. 3 is a partial side view of an alternate embodiment of the platform of the invention depicting a buoyancy module mounted to the bottom of the hull of the platform.

Referring now to FIG. 3, an alternate embodiment of the invention depicts a buoyancy module 32 mounted to the bottom of the hull 12. In the embodiment of FIG. 3, the buoyancy module 32 is added to the offshore platform 10 while it is located in the field to increase the payload capacity of the platform 10 so that additional equipment may be installed on the deck of the platform 10 or so that the platform 10 may be installed at a deeper water site. The buoyancy module 32, like the column extension 22 shown in FIG. 2, is a relatively short cylindrical chamber having a diameter approximately equal to the diameter of the hull 12. Mounting posts 24 secure the module 32 to the hull 12. The mounting posts 24 may be welded or otherwise fixed to the hull 12 and module 32.

Figure 5:
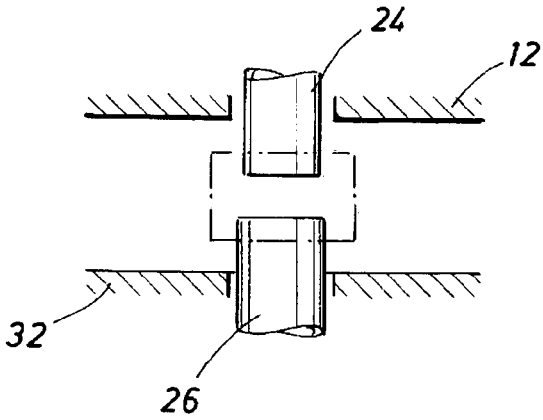
FIG. 5 is a partial exploded view of the connector means for securing the buoyancy module of the invention to the hull of the platform.
Figure 4:
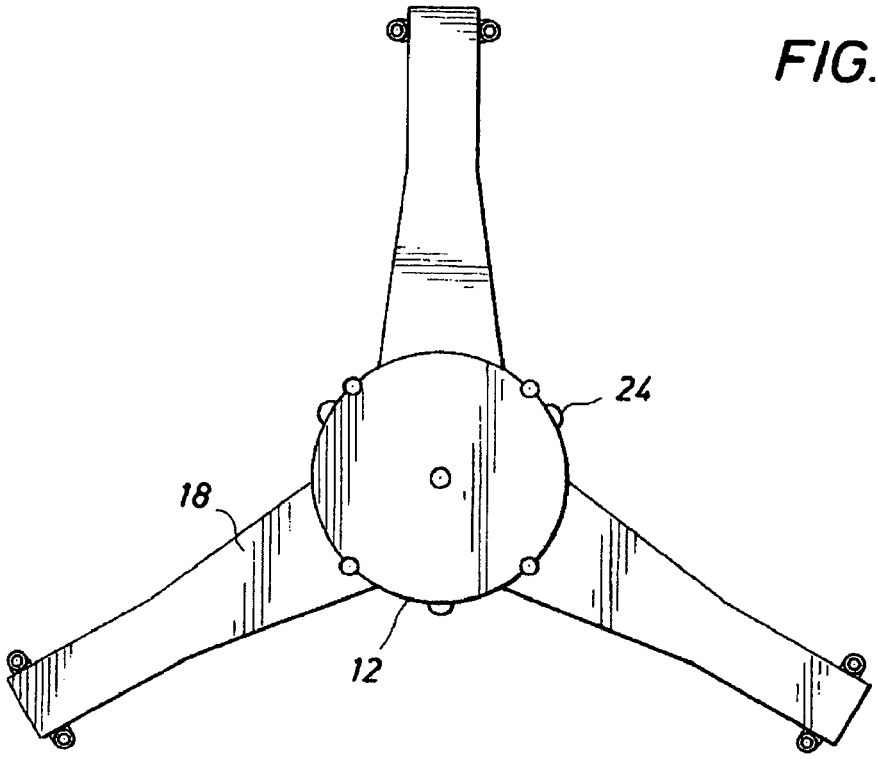
FIG. 4 is a top plan view of the platform of the invention shown in FIG. 3.

Alternatively, the mounting posts 24 may be pre-installed about the periphery of the hull 12, by welding or other connection means, so that the module 32 may be installed at a later time after the platform 10 is anchored offshore, as required, to increase the payload capacity of the platform 10. The buoyancy module 32, shown in FIG. 3, is likewise provided with mounting posts 26 for cooperating engagement with the posts 24 mounted on the hull 12. As more clearly shown in FIG. 5, the mounting posts 24 are adapted to be received or telescoped into the posts 26. Various connections means, such as grout, mechanical connectors or welding, may be employed to lock the post 24 and 26 together and thus secure the buoyancy module 32 to the bottom of the hull 12. This manner of connection has the added benefit of permitting the module 32 to be more easily detached from the hull 12 in the event the payload requirements of the platform 10 change and the buoyancy module 32 is no longer needed or to substitute a larger module in the event greater buoyancy is required. Two or more modules 32 may also be connected in piggy-back manner in vertical alignment with the hull 12 in the event additional buoyancy is required.

Figure 6:
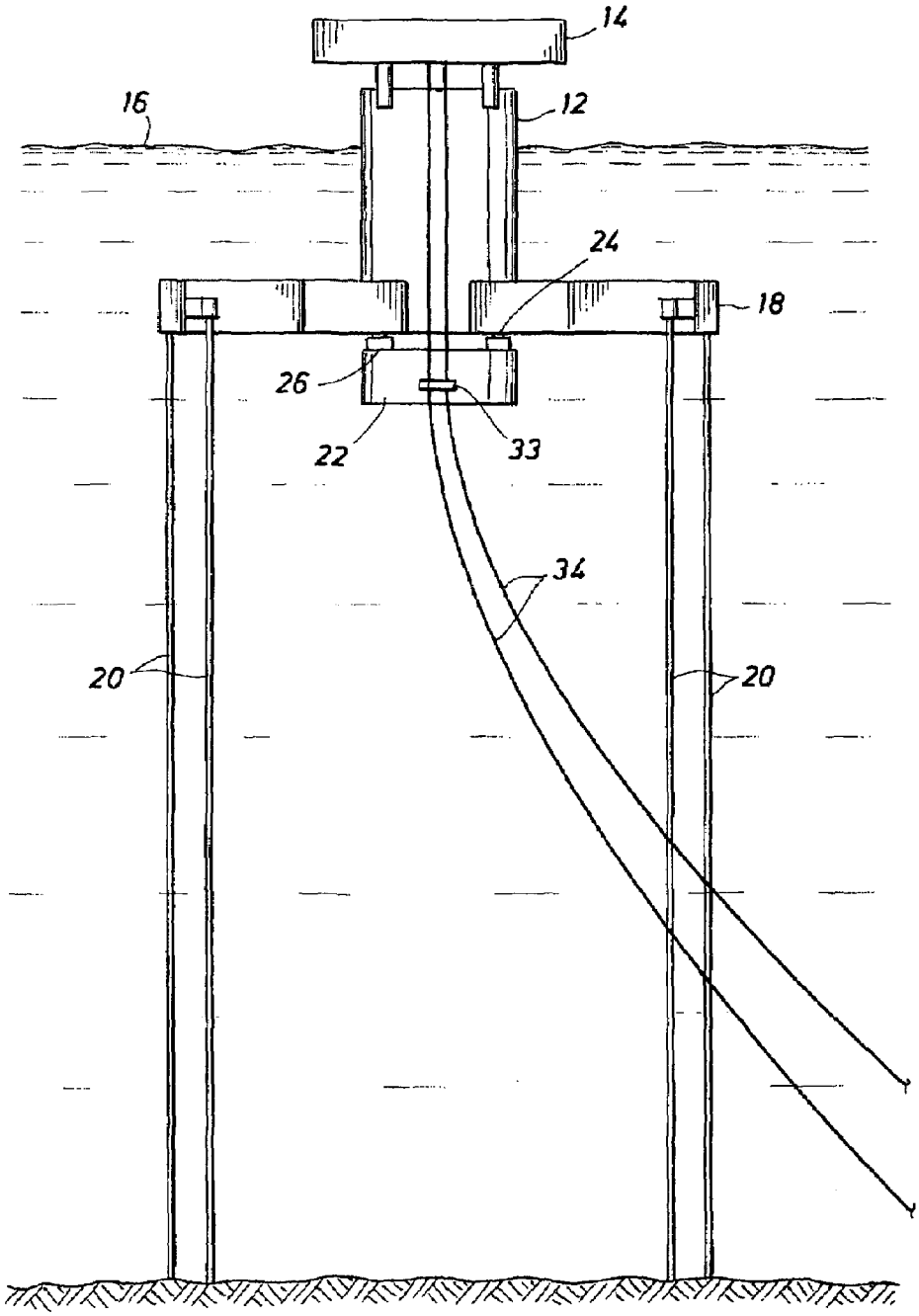
FIG. 6 is a side view of the platform of the invention illustrating riser or flow line support means mounted on the buoyancy module of the invention.

The column extension 22 and buoyancy module 32 may be provided with the necessary plumbing, including a fill port 28 and vent 30, for connection with the ballast system of the platform 10. Additional riser hangers, such as porches 33, for hanging risers or flow lines 34 therefrom, as shown in FIG. 6, may be installed on the column extension 22 or module 32, as required.

The shape of the column extension 22 and module 32 is depicted as a closed cylinder or plug for illustrative purposes. It is understood that the extension 22 and module 32 may comprise various shapes. If, for example, the hull 12 includes a moon pool, the extension 22 and module 32 may be provided with an axial passage for matching alignment with the profile of the moon pool. The extension 22 and module 32 in such an arrangement would have a shape or profile similar to a donut. Likewise, the extension 22 and module 32 may include radial extensions or arms matching the profile of the pontoons 18, which arms may be secured to the bottom of the pontoons 18.

While one or more preferred embodiments of the invention has been shown and described, other and further embodiments of the invention may be devised without departing from the basic scope thereof, and the scope thereof is determined by the claims which follow.

The invention claimed is:

1. A floating platform for supporting variable payloads or operating in different water depths without redesigning the structural design of said platform, comprising:

a) a central column including buoyancy means for supporting a payload in a body of water above the water line;

b) pontoons secured to a lower end of said central column extending radially outwardly therefrom;

c) anchor means securing said platform to the seabed below the water line;

d) supplemental buoyancy means secured to said lower end of said central column below said pontoons; wherein said platform includes a ballast system, and said supplemental buoyancy means includes plumbing for connection with the ballast system of said platform.

2. The platform of claim 1 wherein said supplemental buoyancy means comprises a column extension depending downwardly from said lower end of said central column.

3. The platform of claim 1 wherein said supplemental buoyancy means comprises at least one buoyancy module releasably secured to said lower end of said central column.

4. The platform of claim 3 including connector means for releasably attaching said buoyancy module to said central column.

5. The platform of claim 2 wherein said column extension includes support means on the peripheral surface thereof for supporting one or more risers or flow lines connected to said floating platform.

6. The platform of claim 3 wherein said buoyancy module includes support means on the peripheral surface thereof for supporting one or more risers or flow lines connected to said floating platform.

7. A method for increasing the payload capacity of a floating platform without redesigning the structural design of the hull of said platform, said platform including a central column and buoyancy means for supporting a payload in a body of water above the water line, pontoons secured to a lower end of said central column extending radially outwardly therefrom, a ballast system, and anchor means securing said platform to the seabed below the water line, the method including the step of securing supplemental buoyancy means to said lower end of said central column below said pontoons and providing said supplemental buoyancy means with plumbing for connection with the ballast system of said platform.

8. The method of claim 7 wherein said supplemental buoyancy means comprises a buoyancy module detachable secured below said pontoons on said lower end of said hull.

* * * * *